US008190071B2

(12) United States Patent
Hamakawa

(10) Patent No.: US 8,190,071 B2
(45) Date of Patent: May 29, 2012

(54) DEVELOPING DEVICE FORMING TONER LAYER BY MAGNETIC BRUSH AND IMAGE FORMING APPARATUS USING SAME

(75) Inventor: Hiroyuki Hamakawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 1057 days.

(21) Appl. No.: 12/149,744

(22) Filed: May 7, 2008

(65) Prior Publication Data

US 2008/0310885 A1 Dec. 18, 2008

(30) Foreign Application Priority Data

Jun. 14, 2007 (JP) ..... 2007-156964

(51) Int. Cl.
*G03G 15/09* (2006.01)

(52) U.S. Cl. ..... 399/270

(58) Field of Classification Search ..... 399/258, 399/265, 270

See application file for complete search history.

(56) References Cited

U.S. PATENT DOCUMENTS 6,154,625 A * 11/2000 Saiki et al. ..... 430/123.3
6,298,206 B1 * 10/2001 Toyoshima et al. ..... 399/253
2003/0049054 A1 * 3/2003 Ozawa et al. ..... 399/272

FOREIGN PATENT DOCUMENTS

JP 2003-21961 1/2003
JP 2003-21966 1/2003

* cited by examiner

*Primary Examiner* — David Gray
*Assistant Examiner* — Billy J Lactaoen
(74) *Attorney, Agent, or Firm* — Smith, Gambrell & Russell, LLP

(57) ABSTRACT

The surface of a developing roller is coated with a phenol resin layer at a higher level in triboelectric series than a toner. A positively charged toner supplied from a magnetic roller onto the developing roller is negatively charged by friction with the phenol resin layer at the higher level in the triboelectric series. As a result, the positive charge of the toner is cancelled out, and the charge amount of toner per unit weight on the developing roller (Q/M)s decreases. Applying this principle, relationship between (Q/M)s and the charge amount of toner per unit weight on the magnetic roller (Q/M)m satisfies (Q/M)s<(Q/M)m.

19 Claims, 3 Drawing Sheets

DEVELOPING DEVICE FORMING TONER LAYER BY MAGNETIC BRUSH AND IMAGE FORMING APPARATUS USING SAME

This application is based on Japanese Patent Application No. 2007-156964 filed on Jun. 14, 2007, the contents of which are hereby incorporated by reference.

BACKGROUND OF THE INVENTION

1. Field of the Invention

The present invention relates to a touch-down type developing device that, by using a two-component developer composed of a magnetic carrier and a toner, contactlessly develops an electrostatic latent image on an image carrier while holding only a charged toner on a developing roller, and to an image forming apparatus, such as a copier, a facsimile, or a printer, provided therewith.

2. Description of Related Art

Known as conventional developing methods using a dry toner in an image forming apparatus employing an electrophotographic process are: a monocomponent developing method not using a carrier; and a two-component developing method of, by using a two-component developer for charging a non-magnetic toner with a magnetic carrier, developing an electrostatic latent image on an electrostatic latent image carrier (photoconductor) with a magnetic brush of a toner and a carrier formed on a developing roller.

The monocomponent developing method is suitable for achieving higher quality since an electrostatic latent image on an electrostatic latent image carrier is not disturbed by a magnetic brush. On the other hand, with the monocomponent developing method, the layer thickness on a developing roller is regulated by an elastic regulating blade, so that an additive of the toner may adhere to the developing roller, disturbing toner charge and thus making it difficult to maintain a stable charge amount of toner. Moreover, the toner may adhere to the regulating blade and the developing roller, thereby resulting in ununiform layer formation and thus causing image defect. Moreover, since the layer thickness on the developing roller is regulated by the elastic regulating blade, there arisen problems involved in achieving higher speed and longer life, such as lack of durability in the regulating blade due to the achievement of higher speed.

Moreover, for color printing in which colors are superimposed on one another, a toner needs to be non-magnetic since it is required to have permeability. Thus, in a full-color image forming apparatus, the two-component developing method is adopted in many cases in which only a toner not containing a carrier component is charged and conveyed. However, although the two-component developing method permits maintaining a stable charge amount for a long time and thus is suitable for achieving a toner longer life, this method is disadvantageous in image quality due to the aforementioned influence of the magnetic brush.

Suggested as one of means for solving these problems is, for example, as disclosed in Patent Documents 1 and 2, a so-called touch-down developing method of moving a developer onto a developing roller installed not in contact with an electrostatic latent image carrier (photoconductor) by using a magnetic roller, then transferring a toner onto this developing roller to form a thin layer with the nonmagnetic toner, and dispersing the toner to a latent image on the electrostatic latent image carrier (photoconductor) by an alternating electric field.

With this technique, the two-component developing method is adopted for a toner-charged region in view of achieving a toner longer life, while the monocomponent developing method of contactlessly dispersing only the toner to the photoconductor is adopted for subsequent developing regions for the purpose of achieving higher image quality, so that respective advantages of the monocomponent developing method and the two-component developing method can be taken. Moreover, since the toner is charged in an area between the toner and the carrier, an amount of charged toner is relatively stable, which is advantageous in preventing toner dispersion, fog, etc. Thus, this is the most preferable developing method for a full-color image forming apparatus that is required to achieve higher speed, higher image quality, and a longer life.

However, in the touch-down developing method, an increased charge amount of toner of a small grain size accumulates on the developing roller and an electric field for forming a toner thin layer is thereby weakened, which lowers the toner exchange efficiency on the developing roller, thus causing image concentration deterioration and development hysteresis (ghost).

As a method of preventing the image concentration deterioration and the appearance of a ghost, Patent Document 1 discloses a method of making a potential difference of DC bias between the developing roller and the magnetic roller during the first-cycle toner thin layer formation on the developing roller larger than potential differences during the second-cycle and further-cycle toner thin layer formation to thereby ensure a required amount of a toner layer from the first cycle. Moreover, Patent Document 2 discloses a method of setting at zero a potential difference of DC bias between the developing roller and the magnetic roller during non-image formation and exchanging a toner layer on the developing roller with AC bias only.

However, with the method of Patent Document 1, the image concentration deterioration can be suppressed at the start of driving, but it is difficult to suppress the image concentration deterioration over a long period of time. In Patent Document 2, it is required to provide a long gap between sheets to perform toner layer exchange between the sheets during continuous image formation, thus presenting a problem of a deteriorated image formation success rate.

[Patent Document 1] JP-A-2003-21961

[Patent Document 2] JP-A-2003-21966

SUMMARY OF THE INVENTION

In view of the problems described above, it is an object of the present invention to provide a developing device of a touch-down developing type that is capable of, by properly maintaining the charge amount of toner on a developing roller, preventing concentration deterioration and appearance of a ghost and also preventing electrostatic dispersion during transfer, and an image forming apparatus provided therewith.

To achieve the object described above, one aspect of the invention refers to a developing device including: a toner carrying member arranged so as to oppose an image carrier and developing an electrostatic latent image by dispersing a toner onto a surface of the image carrier by applying developing bias composed of DC and AC components; and a toner supply member forming a toner thin layer on the toner carrying member by using a magnetic brush. A two-component developer containing at least a carrier and a toner is used which satisfies $(Q/M)s<(Q/M)m$, where a charge amount of toner per unit weight on the toner carrying member is $(Q/M)s$ and a charge amount of toner per unit weight on the toner supply member is $(Q/M)m$.

With this configuration, a change in toner charge amount distribution in the developer is reduced and toner dispersion from the developer is also reduced. Therefore, toner exchange on the toner carrying member is promoted, thus making it possible to effectively suppress concentration deterioration and appearance of a ghost. Moreover, a stable charge amount can be maintained for a long period of time, which is also advantageous in achieving a longer life of the developer.

In the developing device described above, a surface of the toner carrying member is coated with a material charged to a same polarity side as a polarity side of the toner by friction with the toner.

With this configuration, (Q/M)s can be easily reduced by utilizing the friction between the toner and the toner carrying member surface.

In the developing device described above, the toner is a positively charged toner, and the surface of the toner carrying member is coated with phenol resin.

With this configuration, when the toner is a positively charged toner, (Q/M)s can be effectively reduced, so that the coating is less likely to peel off and deteriorate.

In the developing device described above, a discharger for performing discharge onto the toner carrying member to thereby reduce the (Q/M)s is provided.

With this configuration, the range of reduction in (Q/M)s can be increased, and it is also easily adjusted.

In the developing device described above, the discharger performs the discharge at voltage setting in which the DC component on a polarity side reverse to a polarity side of the toner is superimposed on the AC component and then an amplitude center is shifted to the polarity side reverse to the polarity side of the toner.

With this configuration, for both a positively charged toner and a negatively charged toner, (Q/M)s can be efficiently reduced.

Another aspect of the invention refers to an image forming apparatus loaded with the developing device described above.

With this configuration, the concentration deterioration and appearance of a ghost are suppressed, thus permitting providing an image forming apparatus capable of image formation with high image quality.

In the image forming apparatus described above, a charge amount of toner per unit weight on the image carrier (Q/M)d is 28 μC/g or less.

With this configuration, toner electrostatic dispersion and transfer failure during toner image transfer from the image carrier can be suppressed.

In the image forming apparatus described above, the (Q/M)s, the (Q/M)m, and the (Q/M)d satisfy $(Q/M)s<(Q/M)d\leqq(Q/M)m$.

With this configuration, performance in toner thin layer formation on the toner carrying member and in developing an electrostatic latent image on the image carrier are stabilized, and performance in toner image transfer from the image carrier can be even more improved.

DETAILED DESCRIPTION OF PREFERRED EMBODIMENTS

Figure 1:
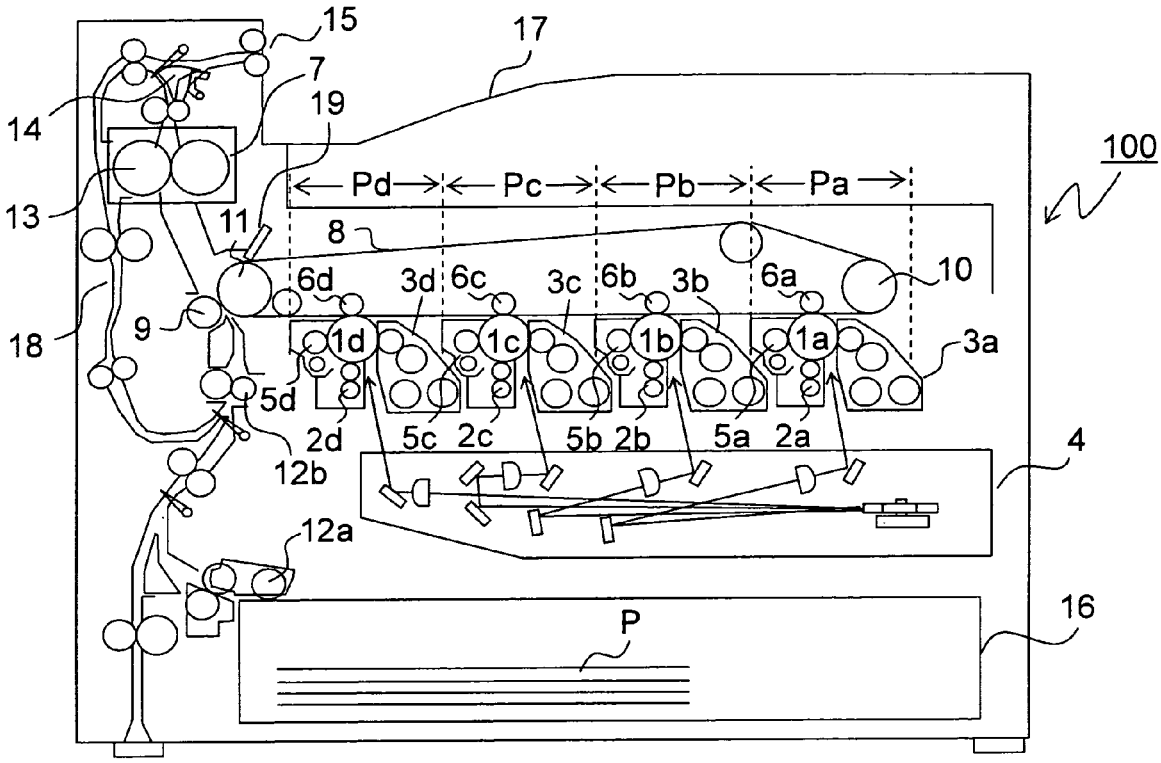
FIG. 1 is a schematic diagram showing overall configuration of an image forming apparatus loaded with a developing device according to the present invention.

Hereinafter, the embodiments of the present invention will be described with reference to the accompanying drawings. FIG. 1 is a schematic sectional view of an image forming apparatus loaded with a developing device of the invention, illustrating a tandem-type color image forming apparatus here. In the main body of the color image forming apparatus 100, four image forming parts Pa, Pb, Pc, and Pd are disposed in order from the upstream side in the conveyance direction (right side in FIG. 1). These image forming parts Pa, Pb, Pc, and Pd are respectively provided in correspondence with images of four different colors (cyan, magenta, yellow, and black), and sequentially form the images of cyan, magenta, yellow, and black through charging, exposure, developing, and transfer processes.

In these image forming parts Pa, Pb, Pc, and Pd, photoconductive drums 1*a*, 1*b*, 1*c*, and 1*d* are respectively disposed which carry visible images (toner images) of the respective colors. The toner images formed on these photoconductive drums 1*a*, 1*b*, 1*c*, and 1*d* are sequentially transferred onto an intermediate transfer belt 8 rotated by a driver (not shown) clockwise in FIG. 1 and moving adjacently to the image forming parts, then transferred onto transfer paper P on a secondary transfer roller 9 all at once, further fixed on the transfer paper P at a fixing part 7, and then discharged from the apparatus main body. While rotating the photoconductive drums 1*a*, 1*b*, 1*c*, and 1*d* counterclockwise, an image forming process on each of the photoconductive drums 1*a*, 1*b*, 1*c*, and 1*d* is executed.

The transfer paper P on which the toner images are transferred is stored in a paper cassette 16 at the bottom of the apparatus, and conveyed to the secondary transfer roller 9 through a feed roller 12*a* and a registration roller pair 12*b*. As the intermediate transfer belt 8, a sheet of dielectric resin is used, and a belt of an endless shape formed by superposing the both sheet ends on each other and joining them together or a belt without seams (seamless belt) is used. Moreover, downstream of the secondary transfer roller 9, a blade-like belt cleaner 19 for removing a toner remaining on the surface of the intermediate transfer belt 8 is arranged.

Next, the image forming parts Pa, Pb, Pc, and Pd will be described. Provided around and below the photoconductive drums 1*a*, 1*b*, 1*c*, and 1*d* rotatably disposed are: chargers 2*a*, 2*b*, 2*c*, and 2*d* for charging the photoconductive drums 1*a*, 1*b*, 1*c*, and 1*d*; an exposure unit 4 for exposing image information to each of the photoconductive drums 1*a*, 1*b*, 1*c*, and 1*d*; developing devices 3*a*, 3*b*, 3*c*, and 3*d* for forming toner images on the photoconductive drums 1*a*, 1*b*, 1*c*, and 1*d*; and cleaning parts 5*a*, 5*b*, 5*c*, and 5*d* for removing a developer (toner) remaining on the photoconductive drums 1*a*, 1*b*, 1*c*, and 1*d*.

When the user inputs image formation start, the chargers 2*a*, 2*b*, 2*c*, and 2*d* first uniformly charge the surfaces of the photoconductive drums 1*a*, 1*b*, 1*c*, and 1*d*, then the exposure unit 4 irradiates light, whereby electrostatic latent images in accordance with an image signal are respectively formed on the photoconductive drums 1*a*, 1*b*, 1*c*, and 1*d*. The developing devices 3*a*, 3*b*, 3*c*, and 3*d* are filled with predetermined amounts of toners of different colors, i.e., cyan, magenta, yellow and black, respectively, by a filling device (not shown). These toners are supplied onto the photoconductive drums 1*a*, 1*b*, 1*c*, and 1*d* by the developing devices 3*a*, 3*b*, 3*c*, and 3*d*, and then electrostatically adhere thereto, whereby toner images are formed in accordance with the electrostatic latent images formed as a result of the exposure by the exposure unit 4.

Then an electric field is provided to the intermediate transfer belt 8 with a predetermined transfer voltage, and then the toner images of cyan, magenta, yellow, and black formed on the photoconductive drums 1*a*, 1*b*, 1*c*, and 1*d* are transferred onto the intermediate transfer belt 8 by intermediate transfer rollers 6*a*, 6*b*, 6*c*, and 6*d*. These images of the four colors are formed in predetermined positional relationship for the purpose of predetermined full-color image formation. Thereafter, in preparation for subsequent new electrostatic latent image formation, the toners remaining on the surfaces of the photoconductive drums 1*a*, 1*b*, 1*c*, and 1*d* are removed by the cleaning parts 5*a*, 5*b*, 5*c*, and 5*d*.

The intermediate transfer belt 8 stretches over a conveyance roller 10 located upstream and a driving roller 11 located downstream. Upon start of clockwise rotation of the intermediate transfer belt 8 following rotation of the driving roller 11 by a driving motor (not shown), the transfer paper P is conveyed at predetermined timing from the registration roller 12*b* to the secondary transfer roller 9 provided adjacently to the intermediate transfer belt 8, and a full-color image is transferred. The transfer paper P with the toner images transferred thereon is conveyed to the fixing part 7.

The transfer paper P conveyed to the fixing part 7 is heated and pressurized by a fixing roller pair 13, whereby the toner images are fixed on the surface of the transfer paper P, thereby forming a predetermined full-color image. The conveyance direction of the transfer paper P with the full-color image formed thereon is divided by a dividing part 14 dividing in a plurality of directions. When an image is to be formed on only one side of the transfer paper P, the transfer paper P is directly discharged by a discharge roller 15 to a discharge tray 17.

On the other hand, when an image is to be formed on the both sides of the transfer paper P, the transfer paper P that has passed through the fixing part 7 is distributed to a paper conveyance path 18 by the dividing part 14, and conveyed again to the secondary transfer roller 9 with its image surface inverted. Then, a next image formed on the intermediate transfer belt 8 is transferred by the secondary transfer roller 9 to the side of the transfer paper P on which no image is formed, conveyed to the fixing part 7, where the toner images are fixed, and then the transfer paper P is discharged to the discharge tray 17.

Figure 2:
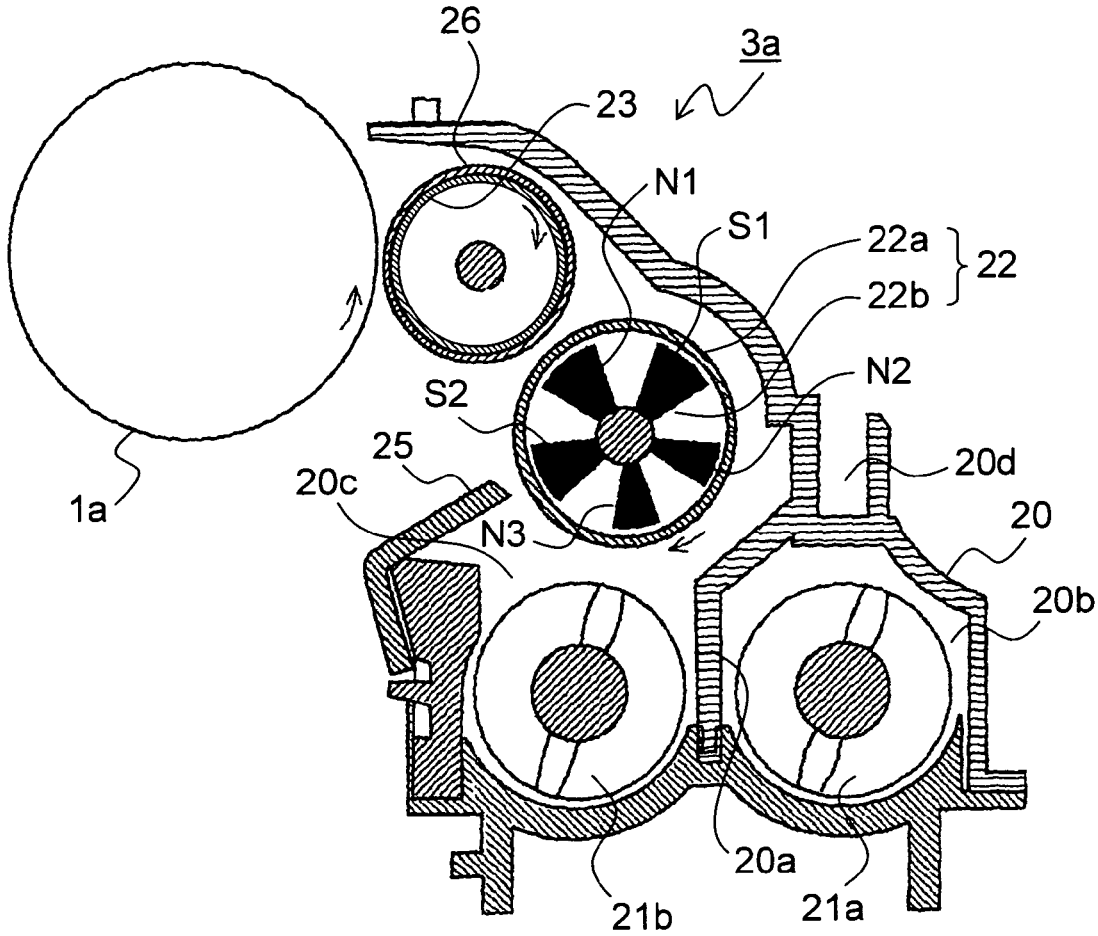
FIG. 2 is a side sectional view showing configuration of a developing device according to a first embodiment of the invention.

FIG. 2 is a side sectional view showing configuration of a developing device according to the first embodiment of the invention. Here, a description is given, referring to the developing device 3*a* arranged at the image forming part Pa of FIG. 1. Basically, the same also applies to the developing devices 3*b*, 3*c*, and 3*d* respectively arranged at the image forming parts Pb, Pc, and Pd, and thus their description will be omitted.

As shown in FIG. 2, the developing device 3*a* includes a developer container 20 storing a two-component developer (hereinafter simply referred to as developer). The developer container 20 is divided into a first and a second stirring chambers 20*b* and 20*c* by a partition wall 20*a*. In the first and second stirring chambers 20*b* and 20*c*, a first stirring screw 21*a* and a second stirring screw 21*b* are rotatably disposed which mix and stir a toner (positively-charged toner) supplied from a toner container (not shown) with a carrier to thereby charge the toner.

Then the developer is conveyed axially while being stirred by the first and second stirring screws 21*a* and 21*b*, and then circulates between the first and second stirring chambers 20*a* and 20*b* through a developer passage (not shown) formed at the partition wall 20*a*. In the illustrated example, the developing device 3*a* extends obliquely leftward and upward, a magnetic roller 22 is arranged above the second stirring screw 21*b* in the developer container 20, and a developing roller 23 is arranged at the diagonal upper left of the magnetic roller 22 in such a manner as to oppose the magnetic roller 22. Then the developing roller 23 opposes the photoconductive drum 1*a* on the opening side of the developer container 20 (left side of FIG. 2), and the magnetic roller 22 and the developing roller 23 rotate clockwise as viewed in the figure.

In the developer container 20, a toner sensor (not shown) is so arranged as to oppose the first stirring screw 21*a*. A toner is filled into the developer container 20 through a toner filling port 20*d* from the toner container in accordance with the toner concentration detected by the toner sensor.

The magnetic roller 22 is composed of a non-magnetic, rotating sleeve 22*a* and a fixed magnet roller body 22*b* having a plurality of magnetic poles contained inside the rotating sleeve 22*a*. In the illustrated example, the fixed magnet roller body 22*b* has five magnetic poles including three N poles (poles N1, N2, and N3) and two S poles (poles S1 and S2). In the rotation direction of the rotating sleeve 22*a*, the pole S1 is arranged between the poles N1 and N2 while the pole S2 is arranged between the poles N3 and N1.

The developing roller 23 is formed of a non-magnetic rotating sleeve, and opposes the rotating sleeve 22*a* of the magnetic roller 22 with a predetermine gap provided at its opposing position. That is, the developing roller 23 opposes the pole N1 with the predetermined gap therebetween.

Moreover, to the developer container 20, a bristle cutting blade 25 is fitted along the longitudinal direction of the rotating sleeve 22*a* (direction vertical to the paper plane of FIG. 2). The bristle cutting blade 25 is located upstream, in the rotation direction of the rotating sleeve 22*a* (clockwise in the figure), of the position where the developing roller 23 and the magnetic roller 22 oppose each other. Then, a small gap is formed between the leading end of the bristle cutting blade 25 and the surface of the rotating sleeve 22*a*.

To the magnetic roller 22 and the developing roller 23, a predetermined DC voltage and a predetermined AC voltage are respectively applied. As described above, the developer circulates inside the developer container 20 while being stirred by the first and second stirring screws 21*a* and 21*b* to thereby charge the toner, and the developer is conveyed by the second stirring screw 21*b* to the magnetic roller 22. Then a magnetic brush (not shown) is formed on the magnetic roller 22, the layer thickness of the magnetic brush on the magnetic roller 22 is regulated by the bristle cutting blade 25, and a toner thin layer is formed on the developing roller 23 by a potential difference between the magnetic roller 22 and the developing roller 23 and a magnetic field between the pole N1 and the developing roller 23. Then the electrostatic latent image formed on the photoconductive drum 1*a* is developed by the toner thin layer formed on the developing roller 23.

A method of regulating the amount of toner on the magnetic roller 22 will be described in detail, referring to FIG. 2. As shown in FIG. 2, since the pole S2 (bristle cutting magnetic pole) opposes the bristle cutting blade 25, use of a non-magnetic body or an N-pole magnetic body as bristle cutting blade 25 results in generation of an attractive magnetic field at the gap between the leading end of the bristle cutting blade 25 and the rotating sleeve 22*a*.

This magnetic field forms a so-called magnetic brush, in which the toner and the carrier stand up in a brush-like form between the bristle cutting blade 25 and the rotating sleeve 22*a*. Then when the rotating sleeve 22*a* rotates clockwise and moves to a position opposing the developing roller 23, an attractive magnetic field is provided between the pole N1 and the developing roller 23, so that the magnetic brush makes contact with the surface of the developing roller 23, thereby forming a toner thin layer.

When the rotating sleeve 22*a* further rotates clockwise, the magnetic brush is now separated from the surface of the developing roller 23 by a magnetic field generated in the horizontal direction (roller circumferential direction) between the poles N1 and S1, so that the toner not used in the toner image formation is collected from the surface of the developing roller 23 onto the rotating sleeve 22*a*. When the rotating sleeve 22*a* further rotates, a repulsive magnetic field is fed by the poles N2 and N3, so that the toner and the carrier separate from the rotating sleeve 22*a* inside the developer container 20. Then after they are stirred and conveyed by the second stirring screw 21*b*, a magnetic brush is formed again on the rotating sleeve 22*a* by a magnetic field of the pole S2. That is, not only by the gap between the bristle cutting blade 25 and the rotating sleeve 22*a* but also by a magnetic filed generated therein, the amount of toner adhering to the magnetic roller 22 is strictly controlled.

In the developing device 3*a* of this embodiment, the surface of the developing roller 23 is coated with a phenol resin layer 26 at a higher level in triboelectric series than a toner. The triboelectric series are those in which, when two types of materials are rubbed against each other to achieve charging, the material easy to be positively (+) charged is arranged at a higher level and the material easy to be negatively (−) charged is arranged at a lower level. The charge polarity of a material varies depending on the other party, and rubbing the material at the higher level and the material at the lower level in the triboelectric series against each other positively charges the material at the higher level and negatively charges the material at the lower level.

That is, a positively charged toner supplied from the magnetic roller 22 onto the developing roller 23 is negatively charged by friction with the phenol resin layer 26 at the higher level in the triboelectric series. As a result, the positive charge of the toner is cancelled out, and the charge amount of toner per unit weight on the developing roller 23 (hereinafter referred to as (Q/M)s) decreases.

Adopting this principle, by making adjustment so that relationship between (Q/M)s and the charge amount of toner per unit weight on the magnetic roller 22 (hereinafter referred to as (Q/M)m) satisfies formula (1) below, a change in toner charge amount distribution in the developer is reduced and toner dispersion from the developer is also reduced.

$$(Q/M)s<(Q/M)m \quad (1)$$

Therefore, toner exchange on the developing roller 23 is promoted, thus making it possible to effectively suppress concentration deterioration and appearance of a ghost even during high-speed image printing at a high printing rate (with high concentration). Moreover, a stable charge amount can be maintained for a long period of time, which is also advantageous in achieving a longer life of the developer.

Moreover, a too large charge amount of toner per unit weight on the photoconductive drum 1*a* (hereinafter referred to as (Q/M)d) causes failure in transfer to the intermediate transfer belt 8 (see FIG. 1) and toner electrostatic dispersion. To maintain favorable performance in toner image transfer from the photoconductive drum 1*a*, it is preferable that (Q/M)d be set at 28 μC/g or less. The (Q/M)d is determined by relationship between a value (Vdc) of a DC voltage applied to the developing roller 23, a peak-to-peak value (Vpp) of an AC voltage, and a potential of the photoconductor surface; therefore, it is advised to adjust Vdc or Vpp so that (Q/M)d is set at 28 μC/g or less.

On the other hand, to stabilizes performance in toner dispersion (performance in developing) onto the photoconductive drum 1*a* from the developing roller 23, it is preferable that (Q/M)s be smaller than (Q/M)d. However, if (Q/M)s is equal to or less than 10 μC/g, the thickness of the toner thin layer on the developing roller 23 increases, thus increasing toner dispersion. Moreover, for smooth toner exchange between the magnetic roller 22 and the developing roller 23, it is preferable that (Q/M)m be set high to some extent.

Therefore, if (Q/M)s, (Q/M)m, and (Q/M)d satisfy formula (2) below, (Q/M)d can be kept low and (Q/M)m and (Q/M)d can also be set high to some extent, which permits preventing electrostatic dispersion and transfer failure during toner image transfer onto the intermediate transfer belt 8 while stabilizing both performance in toner thin layer formation and removal on and from the developing roller 23 and performance in developing an electrostatic latent image on the photoconductive drum 1*a*.

In this embodiment, the surface of the developing roller 23 is coated with the phenol resin layer 26, but any other material may be coated as long as it is at a higher level in the triboelectric series (on the plus side) than the toner. Here, for materials that are close to each other in position in the triboelectric series, the amount of charge by friction is relatively small. Moreover, (Q/M)s varies depending on coating condition such as coated layer thickness, surface roughness, etc. Thus, in accordance with the type of the toner to be used and a target value of (Q/M)s, the coating material and the coating condition may be set appropriately.

Figure 3:
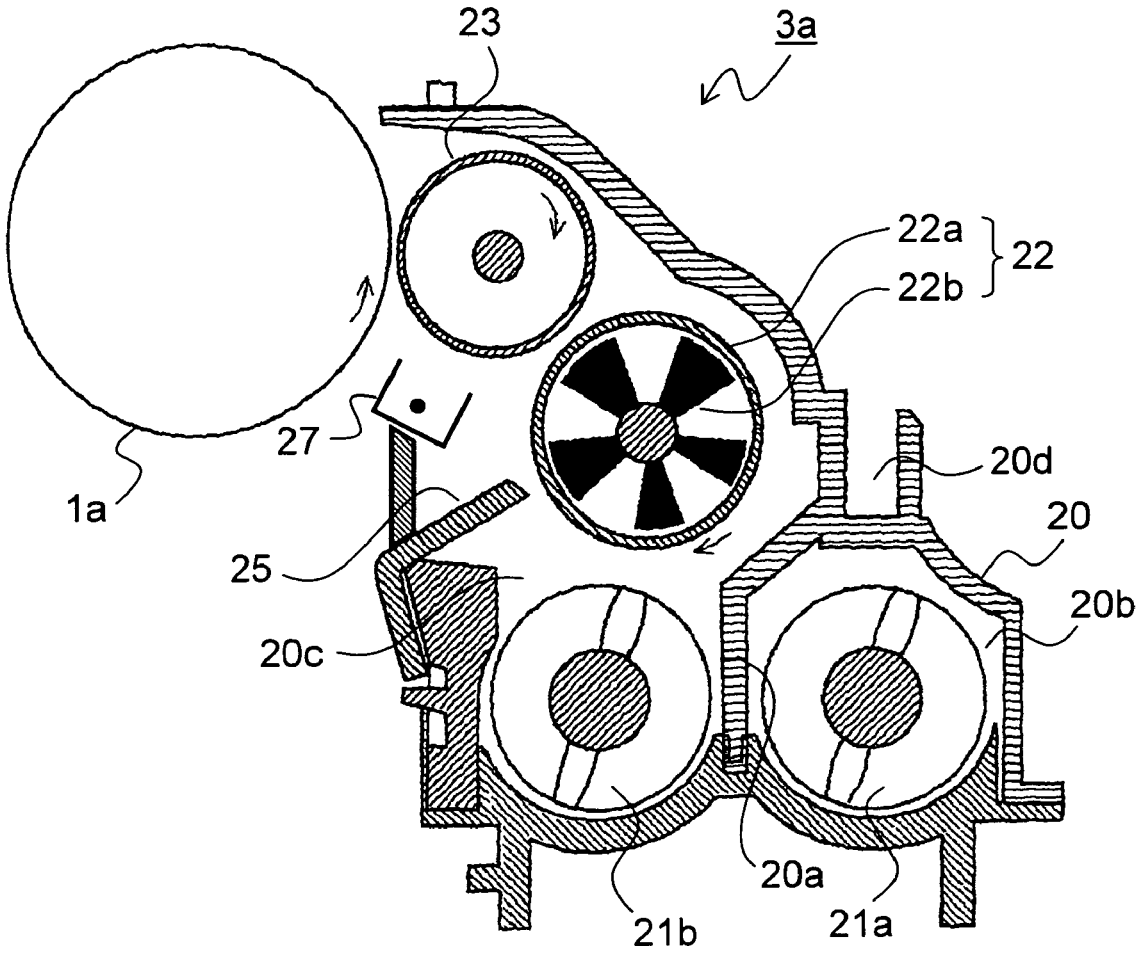
FIG. 3 is a side sectional view showing configuration of a developing device according to a second embodiment of the invention.

FIG. 3 is a side sectional view showing configuration of a developing device according to the second embodiment of the invention. In a developing device 3*a*, a discharger 27 is disposed downstream of a magnetic roller 22 and also upstream of the photoconductive drum 1*a* with respect to the rotation direction of a developing roller 23. Configuration and developing process of other portions are the same as those in FIG. 2 of the first embodiment, and thus their description will be omitted.

In the developing device 3*a* of this embodiment, (Q/M)s is actively reduced by performing discharge on the surface of the developing roller 23 with the discharger 27. As a result, as compared to the first embodiment where positive charge is cancelled out by friction with the phenol resin layer 26, a range of reduction in (Q/M)s can be increased. Moreover, adjustment of bias applied to the discharger 27 makes it easy to control the range of reduction. As the discharger 27, for example, a corona discharge device may be used which discharges by applying a high voltage with, for example, a thin wire or the like serving as an electrode.

For example, in use of a positively charged toner, by performing discharge at bias setting where with an AC voltage and a negative DC voltage superimposed on each other, the amplitude center is shifted to the negative side, the charge amount of toner is adjusted so as to satisfy (Q/M)s<(Q/M)m. As a result, as is the case with the first embodiment, a change in toner charge amount distribution in the developer is suppressed and toner dispersion from the developer is also reduced, which makes it possible to effectively suppress concentration deterioration and appearance of a ghost, thus permitting extending the life of the developer.

Also in this embodiment, it is preferable that the transfer performance be improved by setting (Q/M)d at 28 μC/g or less. For stabilized toner thin layer formation and developing performance on the developing roller 23 in addition to improved transfer performance, it is preferable that (Q/M)s, (Q/M)m, and (Q/M)d be set so that the relationship of the formula (2) above is satisfied. A method of adjusting (Q/M)d is the same as that in the first embodiment, and thus its description will be omitted here.

The invention is not limited to the embodiments described above, and various modifications can be made within a range not deviating from the sprit of the invention. For example, the arrangement (peak position) of the magnetic poles N1, N2, N3, S1, and S2 of the fixed magnet roller body 22*b* and intensities of their magnetic powers may be appropriately set in accordance with the specifications of the developing device, characteristics of the developer, etc. Moreover, not only a magnet roller body with five-pole structure, but also a magnet roller body with, for example, 7-pole structure may be used. Further, at the position in the developing roller 23 opposing the magnetic pole N1, a developing roller side magnetic pole may be arranged which is a magnetic pole (S pole) different from N1.

Moreover, the above embodiments have been described, referring to an example of a developing device that uses a positively charged toner whose charge direction is positive (on a plus side), but the completely same applies to a developing device that uses a negatively charged toner whose charge direction is negative (on a minus side). In this case, the sign of the direction, in the triboelectric series, of the coating material used in the first embodiment or the DC voltage applied to the discharger 27 in the second embodiment become completely opposite to that indicated above. That is, a material at a lower level in the triboelectric series than a toner may be coated in the first embodiment, and in the second embodiment, discharge can be performed at bias setting where, with an AC voltage and a positive DC voltage superimposed on each other, the amplitude center is shifted to the plus side.

Moreover, the description refers to, as an example, a tandem-type color image forming apparatus using an intermediate transfer belt. The invention is applicable in completely the same manner to other types of image forming apparatuses such as a tandem-type color image forming apparatus that performs transfer directly onto a recording medium on a conveyance belt, a digital complex machine, an analog-type monochromatic image forming apparatus, a facsimile, a printer, and the like, as long as they are provided with a developing unit of a touch-down developing type.

EXAMPLE

The invention 1 is defined as a case where the tandem-type color image forming apparatus shown in FIG. 1 is loaded with the developing devices 3*a*, 3*b*, 3*c*, and 3*d* (see FIG. 2) of the first embodiment having the developing roller 23 coated with the phenol resin layer 26. The inventions 2 and 3 are defined as a case where the image forming apparatus described above is loaded with the developing devices 3*a*, 3*b*, 3*c*, and 3*d* of the second embodiment (see FIG. 3) provided with the discharger 27. The invention 4 is defined as a case where the image forming apparatus described above is loaded with the developing devices 3*a*, 3*b*, 3*c*, and 3*d* which have the developing roller 23 coated with the phenol resin layer 26 and also which are provided with the discharger 27. Then developing performance and transfer performance during continuous image printing were investigated. Moreover, the same investigation was performed for a case, as a comparative example, where a conventional developing device having no phenol resin layer 26 and no discharger 27 is loaded.

Test condition common to the inventions 1, 2, 3, and 4 and Comparative example is as follows. A photoconductive drum of amorphous silicon having a diameter of 30 mm was used, the drum surface potential was 350V, and the drum bright potential was 30V. In addition, the developing roller diameter was 20 mm, and the magnetic roller diameter was 25 mm. As development condition, linear speeds of the photoconductive drum, the developing roller, and the magnetic roller were set at 350 mm/sec, 400 mm/sec, and 600 mm/sec, respectively. A gap between the drum and the developing roller was 200 μm, and a gap between the developing roller and the magnetic roller was 350 μm. As a developer, a two-component developer composed of a positively charged toner and an Mn—Mg-based carrier (with 8.0 weight % of toner mixture ratio with respect to the carrier) was used.

In the inventions 1 and 4, a developing roller coated with a phenol resin layer of 20 μm in thickness was used. The surface roughness of the phenol resin layer (arithmetic surface roughness: JISBO601-1994) Ra measured by using a surface roughness measuring device (SURFCOM 1500DX, manufactured by Tokyo Seimitsu Co. Ltd.) was 0.8 μm. The volume resistance value measured with a resistance measuring device (ULTRA HIGH RESISTANCE METER, manufactured by ADVANTEST Corporation) by applying a voltage of 100V between the roller surface and a pipe was $1.4\times10^{-9}\Omega$.

In the invention 1, for the developing roller during toner thin layer formation, a DC bias value (Vdc) was 100V, Vpp of AC bias was 1.6 kV, the frequency was 2.7 kHz, and the duty ratio was 35%. For the magnetic roller during toner thin layer formation, a DC bias value (Vdc1) was 250V, Vpp of AC bias was 1.6 kV, the frequency was 2.7 kHz, and the duty ratio was 65%.

In the invention 2, discharge was performed by applying, to a discharger, bias in which a DC voltage of −1.0 kV is superimposed on a sinusoidal AC voltage having a Vpp of 6 kV. Bias applied to the developing roller and the magnetic roller was the same as that in the first invention.

In the invention 3, discharge was performed by applying, to a discharger, bias in which a DC voltage of −1.5 kV is superimposed on a sinusoidal AC voltage having a Vpp of 6 kV. Bias applied to the developing roller and the magnetic roller was the same as that in the first invention.

In the invention 4, for the developing roller during toner thin layer formation, a DC bias value (Vdc) was 100V, Vpp of AC bias was 1.6 kV, the frequency was 2.7 kHz, and the duty ratio was 35%. For the magnetic roller during toner thin layer formation, a DC bias value (Vdc1) was 250V, Vpp of AC bias was 1.6 kV, the frequency was 2.7 kHz, and the duty ratio was 65%. Moreover, discharge was performed by applying, to a discharger, bias in which a DC voltage of −0.7 kV is superimposed on a sinusoidal AC voltage having a Vpp of 6 kV.

As an evaluation method, 3000 copies of an A4-sized test image (with a printing rate of 2%) were outputted, and charge amounts of toner per unit weight on the developing roller, the magnetic roller, and the photoconductive drum, i.e., (Q/M)s, (Q/M)m, and (Q/M)d, were measured with a QM meter (MODEL 210HS, manufactured by TREK Corporation), and at the same time, it was evaluated by visual check whether or not image concentration deterioration, ghost, and electrostatic dispersion during primary transfer were observed. Table 1 shows results of the test.

TABLE 1

| | (Q/M)m [μC/g] | (Q/M)s [μC/g] | (Q/M)d [μC/g] | Concentration deterioration | Ghost | Electrostatic dispersion during transfer |
|---|---|---|---|---|---|---|
| Invention 1 | 24 | 18 | 21 | Not observed | Not observed | Not observed |
| Invention 2 | 24 | 20 | 28 | Not observed | Not observed | Almost not found |
| Invention 3 | 24 | 14 | 18 | Not observed | Not observed | Not observed |
| Invention 4 | 26 | 20 | 22 | Not observed | Not observed | Not observed |
| Comparative Example | 24 | 30 | 34 | Observed | Observed | Observed |

As is clear from table 1, (Q/M)s was 30 μC/g in the comparative example but it decreased to 18 μC/g, 20 μC/g, 14 μC/g, and 20 μC/g in the inventions 1, 2, 3, and 4, respectively and the concentration deterioration and appearance of a ghost observed in the comparative example were suppressed. Moreover, (Q/M)d, which was 34 μC/g in the comparative example, decreased to 21 μC/g, 28 μC/g, 18 ∞C/g, and 22 μC/g, and the toner electrostatic dispersion during transfer (primary transfer) to the intermediate transfer belt, which was observed in the comparative example, was also suppressed and the transfer performance improved. In the inventions 1, 3, and 4 in particular, which satisfies relationship (Q/M)s<(Q/M)d≦(Q/M)m, the concentration deterioration, ghost, and electrostatic dispersion during transfer were not at all observed.

Based on comparison between the invention 1 and the inventions 2 and 3, the inventions 2 and 3 in which discharge is performed with the discharger, as compared to the invention 1 in which charge is cancelled out by friction with the phenol resin layer, can adjust the ranges of reduction in (Q/M)s and (Q/M)d by electric control, and thus can cope with a variation in the developing performance and the transfer performance due to environmental variation.

As in the invention 4, the configuration in which the phenol resin layer is provided can be combined with the configuration in which discharge is performed with the discharger. In this case, the discharge power can be reduced and also the ranges of reduction in (Q/M)s and (Q/M)d can be adjusted, which is more advantageous.

The development condition in the embodiments described above is just one example, and thus the processing speed, the developing roller diameter, the magnetic roller diameter, etc. can be set appropriately in accordance with the specifications of the image forming apparatus.

In the present invention, a two-component developer containing at least a carrier and a toner is used, and in a touch-down type developing device which has a toner carrying member so arranged as to oppose an image carrier and a toner supply member forming a toner thin layer on the toner carrying member with a magnetic brush, and which develops an electrostatic latent image by dispersing a toner onto a surface of the image carrier by applying to the toner carrying member developing bias composed of DC and AC components, the charge amount of toner per unit weight on the toner carrying member (Q/M)s is made smaller than the charge amount of toner per unit weight on the toner supply member (Q/M)m.

Consequently, a change in toner charge amount distribution in the developer is suppressed and toner dispersion from the developer is also reduced, which permits providing a developing device capable of effectively suppressing concentration deterioration and appearance of a ghost. Moreover, a stable charge amount can be maintained for a long period of time, which also contributes to extending the life of the toner inside the developing device.

If, as means for reducing (Q/M)s, the toner carrying member surface is coated with a material that is charged to the same polarity side as that of a toner by friction with the toner, (Q/M)s can be easily reduced by utilizing the friction between the toner and the toner carrying member surface. When a positively charged toner is used, it is preferable that phenol resin provide high frictional charge effect and excellent durability. Moreover, when a discharger for reducing the charge amount of toner on the toner carrying member is provided, the range of reduction in (Q/M)s can be increased, and it is also easily adjusted.

Loading the developing device of the invention suppresses the concentration deterioration and appearance of a ghost, thus permitting providing an image forming apparatus capable of image formation with high image quality. In this condition, the charge amount of toner on the image carrier (Q/M)d is set at 28 μC/g or less, which can also suppress toner electrostatic dispersion and transfer failure during toner image transfer from the image carrier. Further, satisfying the relationship (Q/M)s<(Q/M)m≦(Q/M)d provides an image forming apparatus providing even more improved performance in toner image transfer from the image carrier while stabilizing performance in toner thin layer formation on the toner carrying member and in developing an electrostatic latent image on the image carrier.

What is claimed is:

1. A developing device comprising:

a toner carrying member arranged so as to oppose an image carrier and developing an electrostatic latent image by dispersing a toner onto a surface of the image carrier by applying developing bias composed of DC and AC components; and a toner supply member forming a thin toner layer on the toner carrying member by using a magnetic brush, wherein a two-component developer containing at least a carrier and a positively charged toner is used which satisfies (Q/M)s<(Q/M)m, where a positive charge amount of toner per unit weight on the toner carrying member is (Q/M)s and a positive charge amount of toner per unit weight on the toner supply member is (Q/M)m.

2. The developing device according to claim 1, wherein a surface of the toner carrying member is coated with a material charged to a same polarity side as a polarity side of the toner by friction with the toner.

3. The developing device according to claim 2, wherein the surface of the toner carrying member is coated with phenol resin.

4. The developing device according to claim 1, wherein a discharger for performing discharge onto the toner carrying member to thereby reduce the (Q/M)s is provided.

5. The developing device according to claim 4, wherein the discharger performs the discharge at a voltage setting in which the DC component on a polarity side reverse to a polarity side of the toner is superimposed on the AC component and then an amplitude center is shifted to the polarity side reverse to the polarity side of the toner.

6. The developing device according to claim 2, wherein a discharger for performing discharge onto the toner carrying member to thereby reduce the (Q/M)s is provided.

7. The developing device according to claim 6, wherein the discharger performs the discharge at a voltage setting in which the DC component on a polarity side reverse to the polarity side of the toner is superimposed on the AC component and then an amplitude center is shifted to the polarity side opposite to the polarity side of the toner.

8. An image forming apparatus loaded with the developing device according to claim 1.

9. The image forming apparatus according to claim 8, wherein the positive charge amount of toner per unit weight on the image carrier (Q/M)d is 28 uC/g or less.

10. An image forming apparatus comprising a developing device, the developing device including:

toner carrying member arranged so as to oppose an image carrier and developing an electrostatic latent image by dispersing a toner onto a surface of the image carrier by applying developing bias composed of DC and AC components; and a toner supply member forming a thin toner layer on the toner carrying member by using a magnetic brush, wherein a two-component developer containing at least a carrier and a positively charged toner is used which satisfies (Q/M)s<(Q/M)m, where a positive charge amount of toner per unit weight on the toner carrying member is (Q/M)s and a positive charge amount of toner per unit weight on the toner supply member is (Q/M)m, wherein a positive charge amount of toner per unit weight on the image carrier (Q/M)d is 28 μC/g or less, and wherein (Q/M)s, (Q/M)m, and (Q/M)d satisfy (Q/M)s<(Q/M)d≦(Q/M)m.

11. The image forming apparatus loaded with the developing device according to claim 2.

12. The image forming apparatus according to claim 11, wherein the positive charge amount of toner per unit weight on the image carrier (Q/M)d is 28 μC/g or less.

13. The image forming apparatus according to claim 12, wherein the (Q/M)s, the (Q/M)m, and the (Q/M)d satisfy (Q/M)s<(Q/M)d≦(Q/M)m.

14. The image forming apparatus loaded with the developing device according to claim 4.

15. The image forming apparatus according to claim 14, wherein the positive charge amount of toner per unit weight on the image carrier (Q/M)d is 28 μC/g or less.

16. The image forming apparatus according to claim 15, wherein the (Q/M)s, the (Q/M)m, and the (Q/M)d satisfy (Q/M)s<(Q/M)d(Q/M)m.

17. The image forming apparatus loaded with the developing device according to claim 6.

18. The image forming apparatus according to claim 17, wherein the positive charge amount of toner per unit weight on the image carrier (Q/M)d is 28 μC/g or less.

19. The image forming apparatus according to claim 18, wherein the (Q/M)s, the (Q/M)m, and the (Q/M)d satisfy (Q/M)s<(Q/M)d(Q/M)m.

* * * * *